United States Patent [19]

Taylor

[11] 3,974,876

[45] Aug. 17, 1976

[54] DOWNHOLE FLUID FLOW REGULATOR

[76] Inventor: Julian S. Taylor, 8300 SW. 8, Oklahoma City, Okla. 73108

[22] Filed: Sept. 15, 1975

[21] Appl. No.: 613,767

[52] U.S. Cl. ..... 166/65 R; 137/504; 166/106; 166/188; 166/224 A

[51] Int. Cl.[2] ..... F16K 31/163; F16K 31/36

[58] Field of Search..... 137/504; 166/65 R, 106, 166/133, 188, 224

[56] References Cited

UNITED STATES PATENTS

| | | | |
|---|---|---|---|
| 3,319,717 | 5/1967 | Chenoweth | 137/504 X |
| 3,472,275 | 10/1969 | Castro et al. | 137/504 X |

*Primary Examiner*—Henry T. Klinksiek
*Attorney, Agent, or Firm*—Robert K. Rhea

[57] ABSTRACT

An elongated tubular housing, having inlet and outlet ports, forms a fluid passageway. A piston, loosely received by the inlet end portion of the housing, is coaxially connected with a throttle regulator comprising poppet type valves and a stem which extends through and seats the valves on respective end portions of a cage positioned in the outlet end portion of the housing. A spring, interposed between the piston and the cage, normally biases the valves toward an open position and acts to position the balanced valves at the respective end portions of the cage in response to constant fluid pressure drop across the piston.

7 Claims, 3 Drawing Figures

DOWNHOLE FLUID FLOW REGULATOR

BACKGROUND OF THE INVENTION

1. Field of the invention.

The present invention relates to constant fluid flow regulators and more particularly to a downhole flow regulator having a spring urged piston connected with poppet type valves and arranged for equalizing fluid pressure at opposite end of the poppet valves.

In the oil producing industry it is frequently desired to inject fluid, such as water, into an oil bearing formation penetrated by a borehole to flood the oil bearing formation and force the oil toward other adjacent boreholes penetrating the oil bearing formation to increase oil recovery therefrom. Many times the boreholes pass through a water bearing sand or formation spaced above the oil production zone which is normally sealed off as by casing and/or cementing.

2. Description of the prior art.

Heretofor it has been common practice in oil well water flooding to obtain the water from a well or other suitable source and pump the water into a selected oil well borehole penetrating the oil bearing formation to be flooded.

This invention eliminates the need for obtaining water from another source and transporting it, by a pipeline or other means, to the well location where the water is to be pumped into the oil formation by utilizing water obtained from the selected oil well in a water containing formation spaced above the oil bearing formation.

SUMMARY OF THE INVENTION

A tubular member, such as a length of casing or pipe, is provided with a motor driven downhole pump arranged to force the fluid through the depending end of the pipe. The upper end portion of the pipe is provided with an inlet coupling or collar joined to a supporting strand having electrical conductors for operating the motor and pump. A poppet valve type equipped flow regulating device, having a cage provided with outlet ports for water, is axially connected with the depending end of the motor and pump containing pipe. The assembled device is lowered into a cased borehole by the supporting strand and sealed with the inner wall of the borehole casing by a conventional packer intermediate the length of the motor containing pipe and spaced below the water bearing formation after perforating the borehole casing to admit water to the borehole. The flow regulator cage is preferably positioned adjacent the oil bearing formation desired to be flooded so that water pumped through the flow regulating device is forced into the oil bearing formation through perforations in the borehole casing or directly into the oil bearing formation in the event the depending end of the borehole casing is spaced above the oil bearing formation.

The principal object of this invention is to provide a flow regulator for pumping and injecting water from a water containing formation, spaced above an oil bearing formation, into the oil bearing formation in the same borehole.

DESCRIPTION OF THE PREFERRED EMBODIMENTS

Figure 2:
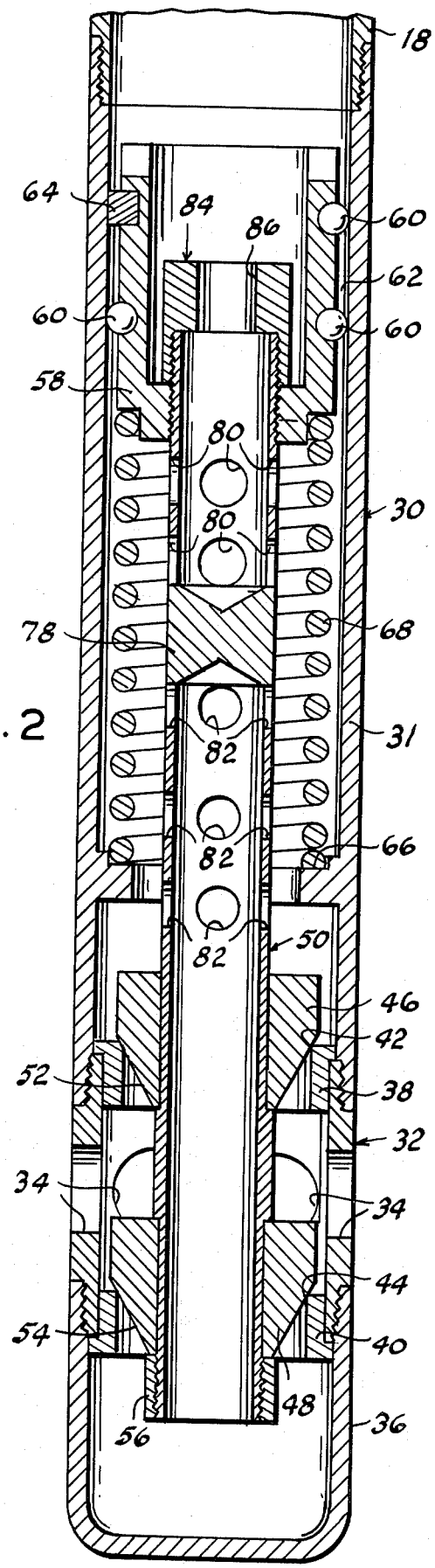
FIG. 2 is a vertical cross sectional view taken substantially along the line 2—2 of FIG. 1; and, FIG. 3 is a cross sectional view of an alternative lock nut orifice.

Like characters of reference designate like parts in those figures of the drawings in which they occur.

In the drawings:

The reference numeral 10 indicates a borehole passing through a water bearing formation 12 and an oil bearing formation 14 having casing 16 therein.

The numeral 18 indicates a length of pipe or casing containing a conventional downhole pump 19 and motor 20 supported from the surface of the earth by a cable 21 provided with electrical conductors 22 for operating the motor. Water 23 from the formation 12 enters the casing through perforations 24 formed therein and enters the pipe 18 through a perforated pump inlet 26. Intermediate its ends the periphery of the pipe 18 is sealed with the inner wall surface of the casing 16 below the water formation 12 and above the oil formation 14 by a conventional packer 28.

A flow regulator 30 is coaxially secured to the depending end of the pipe 18. The flow regulator 30 comprises a tubular body or housing 31 connected at its depending end with a sleeve-like cage 32 having an inside diameter substantially equal to the inside diameter of the housing 31 and having a circumferential row of outlet ports 34 in its periphery. The depending end of the cage is closed by a bull plug 36. The respective end portions of the cage 32 is provided with annular rings 38 and 40, forming upwardly facing valve seats 42 and 44, respectively. First and second substantially equal diameter poppet valves 46 and 48, respectively, are secured in spaced relation to the periphery of a poppet valve stem or bypass tube 50 having a length less than the length of the housing 31 and coaxially disposed therein. Diametrically the bypass tube 50 is substantially smaller than the inside diameter of the housing 31 for reasons believed readily apparent. Each of the valves 46 and 48 are provided with annular downwardly facing tapered seats 52 and 54, respectively, for mating with the seats 42 and 44. The spacing between the poppet valves 46 and 48, relative to their respective seats 42 and 44 is substantially equal. An end nut 56 secures the second or lowermost valve 48 to the bypass tube 50.

A sleeve-like piston 58 is threadedly secured to the upper end portion of the bypass tube 50. The piston 58 is diametrically smaller than the inside diameter of the housing 31 by a predetermined dimension and its outer surface is provided with ball-like friction reducing bearings 60 to insure free vertical movement of the piston within the housing 31 and forms an annular flow path 62 therebetween. Alternatively, the piston may be provided with synthetic material guides, as at 64, embedded in its outside wall surface and provided with an outwardly disposed arcuate surface formed on a radius the same as the inside radius of the housing 31 for slidably contacting the inner wall surface of the housing 31. Intermediate its ends, between the depending end of the piston 58 and above the uppermost valve 46, the housing 31 is provided with an inwardly directed annular flange forming a shoulder 66 loosely surrounding the bypass tube 50 for seating one end of a spring 68 interposed between the depending end of the piston 58 and the annular shoulder 66.

Intermediate its ends the bypass tube 50 has interposed therein a stop plug 78. Above the stop plug 78 the bypass tube 50 is provided with a plurality of piston bypass ports 80 and similarly below the stop plug 78 the bypass tube 50 is provided with a plurality of poppet inlet ports 82. A lock nut 84, within the piston 58, secures it to the upper end portion of the bypass tube 50. The lock nut 84 is centrally drilled, as at 86, on a selected diameter to form a fluid inlet orifice.

Figure 3:
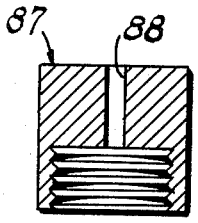
Figure 1:
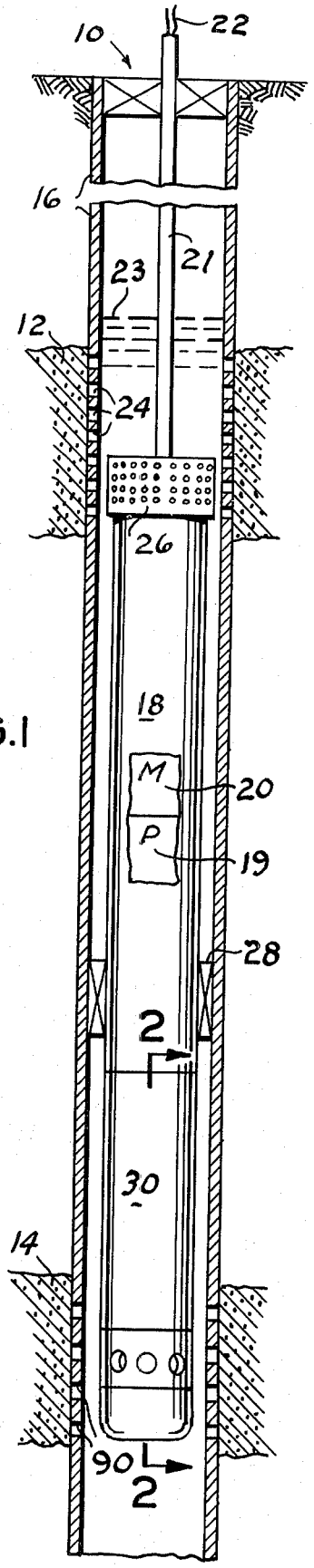
FIG. 1 is a fragmentary vertical cross sectional view, partially in elevation, of a borehole having the components of the invention installed therein in operative position.

FIG. 3 illustrates another embodiment of the lock nut, indicated at 87, which is provided with a relatively small diameter orifice 88 for replacing the lock nut 84 when it is desired to increase the pressure drop across the position of the piston 58. Minimal flow across the piston 58 may be obtained by blocking the lock nut orifice or using an imperforate lock nut, not shown. Obviously the transverse cross sectional area of the flow passage 62 may be decreased by increasing the diameter of the piston 58 to increase the pressure drop across the piston.

OPERATION

In operation, the spring 68 normally maintains the poppet valves 46 and 48 unseated. When the downhole pump is started, water is forced, under pump pressure, down the pipe 18 into the upper end of the housing 31 against the piston 58. The pressure drop, along the axis of the piston 58, creates a force against the transverse area of the piston to create a balance with the force of the spring 68. Should the flow increase, as would occur with an upstream pressure increase or a downstream pressure decrease, the pressure drop across the piston will increase. This pressure increase on the piston area moves the balanced valves 46 and 48 toward their respective, relatively equal diameter, seats 42 and 44 to decrease flow through the cage 32. A new balance would then be achieved to bring the flow to its original constant value.

To change flow rate rapidly, without remachining the piston, to change the annular area of the passageway 62, lock nut orifices, similar to 86 or 88, are used to bypass the piston 58 with additional flow without changing the piston force vs. the spring force. Minimum flow may be achieved with a solid lock nut without a bypass orifice.

Water pressure in the depending end of the casing 16, below the packer 28 and surrounding the flow regulator 30, forces the water into the oil formation 14 through perforations 90 formed in the casing 16 in its portion extending into or through the oil formation 14. In the event the borehole casing 16 does penetrate the oil formation the perforations 90 are obviously omitted.

Obviously the invention is susceptible to changes or alterations without defeating its practicability. Therefore, I do not wish to be confined to the preferred embodiment shown in the drawings and described herein.

I claim:

1. A fluid flow regulator, comprising:

a tubular housing having an inlet end and a closed end and having an annular shoulder intermediate its ends;

a tubular cage interposed in the housing between said annular shoulder and the closed end, said cage having a lateral port forming the outlet of a flow passageway through said housing and said cage, said cage having a pair of valve seats facing toward the housing inlet end and disposed, respectively, on the upstream and downstream sides of the lateral port;

a sleeve piston intersecting the flow passageway and being loosely received by said housing adjacent its inlet end for forming a restricted annular flow passageway around said piston;

an elongated tube connected with the bore of said sleeve piston and projecting through said cage;

a pair of valves secured in spaced relation to the periphery of said tube for seating and unseating on said valve seats and opening and closing the fluid passageway in response to movement of said sleeve piston toward and away from said cage;

resilient means interposed between said shoulder and said sleeve piston normally biasing said piston toward the housing inlet end in a valve unseating position; and, means associated with said sleeve piston for increasing or decreasing the flow capacity through said housing a predetermined quantity.

2. The flow regulator according to claim 1 and further including:

a stop interposed in said tube between said annular shoulder and said piston, said tube having an outlet port in its wall between said stop and said piston and having an inlet port in its wall between said stop and the upstream valve.

3. The flow regulator according to claim 2 in which said associated means includes:

a flow restricting lock nut secured to the upstream end of said tube.

4. The flow regulator according to claim 3 and further including:

friction reducing bearing means carried by the periphery of said sleeve piston.

5. In combination with a casing suspended within a borehole passing through a water producing formation spaced above an oil containing formation, said casing forming a fluid passageway and containing a motor driven pump for forcing fluid downwardly through the passageway, electrical conductors connecting a source of electrical energy with said motor and packing means sealing an intermediate peripheral portion of said casing with the borehole wall, the improvement comprising:

a tubular housing depending from said casing and having its depending end closed and having an annular shoulder intermediate its ends; a tubular cage interposed in the housing between said annular shoulder and the closed end, said cage having a lateral port forming the outlet of a flow passageway through said housing and said cage, said cage having a pair of valve seats facing toward the upper end of said housing and disposed, respectively, on the upstream and downstream sides of the lateral port;

a sleeve piston intersecting the flow passageway and being loosely received by said housing adjacent its upper end for forming a restricted annular flow passageway around said piston;

an elongated tube connected with the bore of said sleeve piston and projecting through said cage;

a pair of valves secured in spaced relation to the periphery of said tube for seating and unseating on said valve seats and opening and closing the fluid passageway in response to movement of said sleeve piston toward and away from said cage;

resilient means interposed between said shoulder and said sleeve piston normally biasing said piston toward the upper end of the housing in a valve unseating position; and, means associated with said sleeve piston for increasing or decreasing the flow capacity through said housing a predetermined quantity.

6. The combination according to claim 5 and further including:

a stop interposed in said tube between said annular shoulder and said piston, said tube having an outlet port in its wall between said stop and said piston and having an inlet port in its wall between said stop and the upstream valve.

7. The combination according to claim 5 in which said associated means includes:

a flow restricting lock nut secured to the upstream end of said tube.

* * * * *